US006920030B2

(12) United States Patent
Chase et al.

(10) Patent No.: US 6,920,030 B2
(45) Date of Patent: Jul. 19, 2005

(54) APPARATUS FOR ELIMINATING STATIC ELECTRICAL CHARGES FROM A WEB OF DIELECTRIC SHEET MATERIAL

(75) Inventors: Lee M. Chase, Los Gatos, CA (US); Steve Axelrod, Los Altos, CA (US); Robert L. Beaman, San Jose, CA (US); Leon Tao, San Francisco, CA (US)

(73) Assignee: Honeywell International Inc., Morristown, NJ (US)

( * ) Notice: Subject to any disclaimer, the term of this patent is extended or adjusted under 35 U.S.C. 154(b) by 411 days.

(21) Appl. No.: 10/216,133

(22) Filed: Aug. 8, 2002

(65) Prior Publication Data

US 2004/0027778 A1 Feb. 12, 2004

(51) Int. Cl.[7] ..... H05F 3/00
(52) U.S. Cl. ..... 361/214
(58) Field of Search ..... 361/214, 212; 399/315

(56) References Cited

U.S. PATENT DOCUMENTS

| | | | | |
|---|---|---|---|---|
| 3,735,198 A | | 5/1973 | Barnett et al. | |
| 3,757,164 A | | 9/1973 | Binkowski | |
| 3,904,929 A | | 9/1975 | Azuma et al. | |
| 4,494,166 A | | 1/1985 | Billings et al. | |
| 4,739,363 A | * | 4/1988 | Hoshika et al. | 399/315 |
| 5,043,759 A | | 8/1991 | Sakai | |
| 5,132,654 A | * | 7/1992 | Walgrove et al. | 399/315 |
| 5,400,208 A | | 3/1995 | Pazda et al. | |
| 5,420,743 A | * | 5/1995 | Domes | 361/214 |
| 6,498,913 B1 | * | 12/2002 | Tooker et al. | 399/90 |

OTHER PUBLICATIONS

PCT International Search Report dated Feb. 12, 2004.

* cited by examiner

*Primary Examiner*—Stephen W. Jackson
*Assistant Examiner*—Boris Benenson
(74) *Attorney, Agent, or Firm*—Anthony Miologos

(57) ABSTRACT

An apparatus is taught for draining static electrical charges build-up on a traveling web of dielectric material. The apparatus includes discharge means comprised of a metal member having one end formed into at least one needle point projection. The discharge means is connected to ground potential and mounted in close proximity to the traveling web. Responsive to concentrated static electrical charges the discharge means causes ionization of the gasses surrounding the discharge means, thereby draining the static electrical charges to the ground potential through the discharge means. The apparatus further includes means for sensing and reading the magnitude of static electrical charges drawn from the web of dielectric material and for applying the sensed information as digital signals to a manufacturing controller. The manufacturing controller uses the information to control manufacturing parameters that minimize the generation of static electrical charges during the manufacture of the dielectric material.

9 Claims, 4 Drawing Sheets

APPARATUS FOR ELIMINATING STATIC ELECTRICAL CHARGES FROM A WEB OF DIELECTRIC SHEET MATERIAL

BACKGROUND OF THE INVENTION

1. Field of the Invention

The present invention relates generally to an apparatus for reducing static electrical charges on the surface of an object and, more specifically, to an apparatus for reducing static electrical charges on the surface of a web of dielectric sheet material during its manufacture or handling.

2. Discussion of the Related Art

Static electrical charges are generated on a web of dielectric sheet material, such as paper and plastic, by contact with charged rollers or webs or by frictional contact with stationary guide surfaces necessary to transport the sheet through its manufacture or handling. The build-up of these charges can become a severe problem. Such static electrical charges can cause static electrical discharges, arcing, or sparks which can disrupt or damage nearby electronic equipment or affect the accuracy of sensors used in the manufacture or handling of such sheet materials. Additionally, the static electrical charges present on a web of dielectric sheet material may attract dust and dirt to the web and the manufacturing equipment, may pose a dangerous annoyance to operators of the equipment, or may present an explosion hazard in an explosive atmosphere. Thus, many types of devices have been used to reduce or remove such static electricity build-up from a web of sheet material during its manufacture or handling.

One such device is a contact neutralizer. These devices generally comprise a multiplicity of metal projections on an electrically grounded support which may be positioned transverse to the path of a sheet and be spaced so that the projections come into physical contact with successive sections of the surface of a passing sheet. These prior art devices have disadvantages in that they tend to scratch, mar or tear the surface of sheet material that has a delicate surface or coating. Also, the contact pressure that results between a passing sheet and the relatively stiff metallic projections of prior art contact neutralizers may tend to divert the path of the web of sheet material from its optimal intended path or to slow its speed, so that the manufacture or handling of such sheet material is not orderly and predictable. Similar difficulties are encountered when metallic grounding rollers are added along the path of a web of sheet material; and even when such rollers can be properly incorporated into the design of manufacturing or handling equipment, the cost of manufacturing and mounting such rollers may be relatively high.

Still other prior art devices known in the industry and used to neutralize static electrical charges from a web of sheet material are high-voltage and radioactive neutralizers. These devices ionize the air around an adjacent surface to afford a path to ground through the ionized air and the neutralizer to conduct away electrostatic charges on a surface contacted by the ionized air. One disadvantage of these devices is that they are relatively expensive to purchase, install and operate, as they require either a radioactive source, which requires occasional replacement, or a high voltage potential to be generated.

BRIEF SUMMARY OF THE INVENTION

Therefore, in accordance to the present invention, there is provided an apparatus for draining and measuring concentrated static electrical charges build-up on a traveling web of dielectric material. The apparatus of the present invention is comprised of at least one discharge means formed as a monolithic metal foil member that includes a plurality of spaced apart needle point projections extending from the metal foil member. The discharge means is connected to ground potential with each needle point projection of the plurality of needle point projections mounted in close proximity to the surface of the web of dielectric material and in a cross-direction to the direction of travel of the web. Responsive to concentrated electrically charged fields encountered by the needle point projections, ionization of the gasses surrounding the discharge means occurs, forming a conductive path that drains the static electrical charges to ground potential through the discharge means.

The apparatus further includes voltage sensing means connected between the discharge means and the ground potential. The voltage sensing means is arranged to develop a voltage whose magnitude is proportional to the magnitude of the static electrical charges drained from the web of dielectric material. Measuring means are connected across the voltage sensing means to indicate the magnitude of the voltage sensed by the voltage means.

The apparatus further includes analog-to-digital circuit means connected to the voltage sensing means. The analog-to-digital circuit means receives the voltage produced by the voltage sensing means and produces digital signals representative of the magnitude of the voltage sensed. Signal transmission means connected to the analog-to-digital circuit means and to a manufacturing controller receives the digital signals from the analog-to-digital circuit means and transmits the digital signals to the manufacturing controller. The controller uses the digital signals to change certain parameters, such as the moisture content, that influence the generation of static electrical charges, therefore minimizing the creation of static electrical charges during the manufacture of the web of dielectric materials.

It is, therefore, an object of the present invention to provide an apparatus, which removes static electrical charges from a moving web of dielectric material.

It is also an object of the present invention to provide a apparatus which can measure and determine how much static electrical potential was removed from the moving web of dielectric material.

It is also an object of the present invention to provide an apparatus that can report the amount of static electrical potential removed in order to control certain parameters of manufacture to reduce the amount of static electrical fields build-up on the web of dielectric material.

BRIEF DESCRIPTION OF THE SEVERAL VIEWS OF THE DRAWINGS

Other objects, features, and advantages of the present invention will be apparent from the following description of a preferred embodiment thereof, taken in conjunction with the sheets of drawings, in which.

DETAILED DESCRIPTION OF THE INVENTION

It is known from theory that concentrated electrical fields cause spontaneous electron emission from metals, leading to the subsequent ionization of surrounding gasses. Since an ionized gas can act as a conductor, this particular property can be used to advantage to discharge static build-up before discharge or arcing occurs. Therefore, a sharp metal needle connected to a ground potential and placed near the static build-up will disrupt and concentrate the electrical field in the immediate vicinity of the needle point, ionize the air, and discharge the static electricity safely to ground. By this mechanism, static electrical charges on the section of a web of sheet material passing a grounded projection, such as a needle, is afforded a path to ground.

Figure 1:
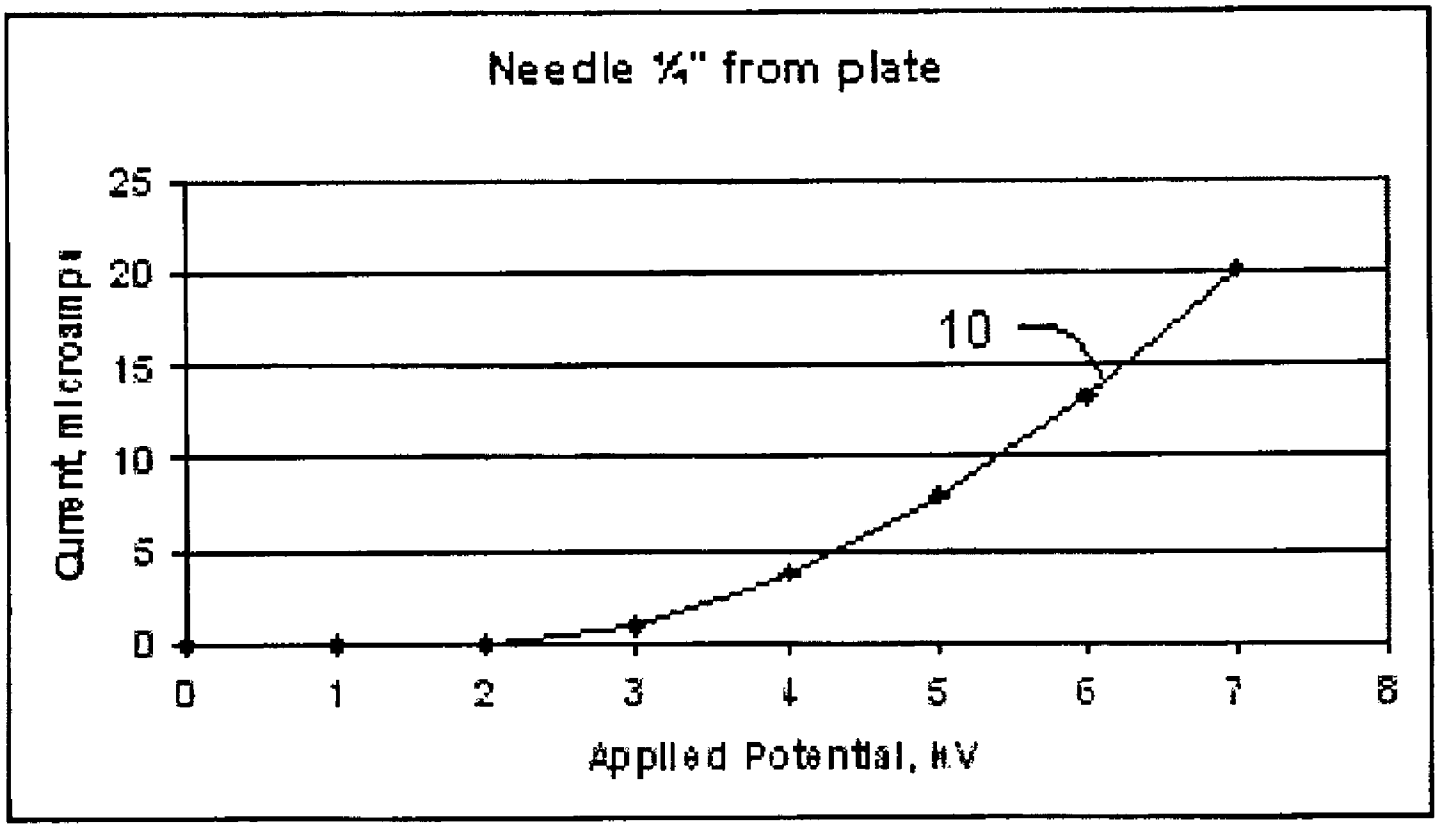
FIG. 1 is a graphical plot of the current drawn by a single-needle conductor as a function of an applied potential.

Turning to FIG. 1, a graph is shown which plots the current drawn from a single needle as a function of an applied potential. The shape of the curve 10 is explained by the ionization of the air in the concentrated electrical field near the single needle projection. At low applied potentials 0–2 kV, the electric field is too weak to ionize the air. However, above 2 kV ionization begins and current begins to flow. Ionization and the resultant current draw increase with the increase of applied potential until arching occurs. Therefore, as shown, a single needle projection set approximately at 5 mm (0.200 inches) from a statically charged sheet will draw 20 microamps of current at a 7 kV potential.

Figure 2:
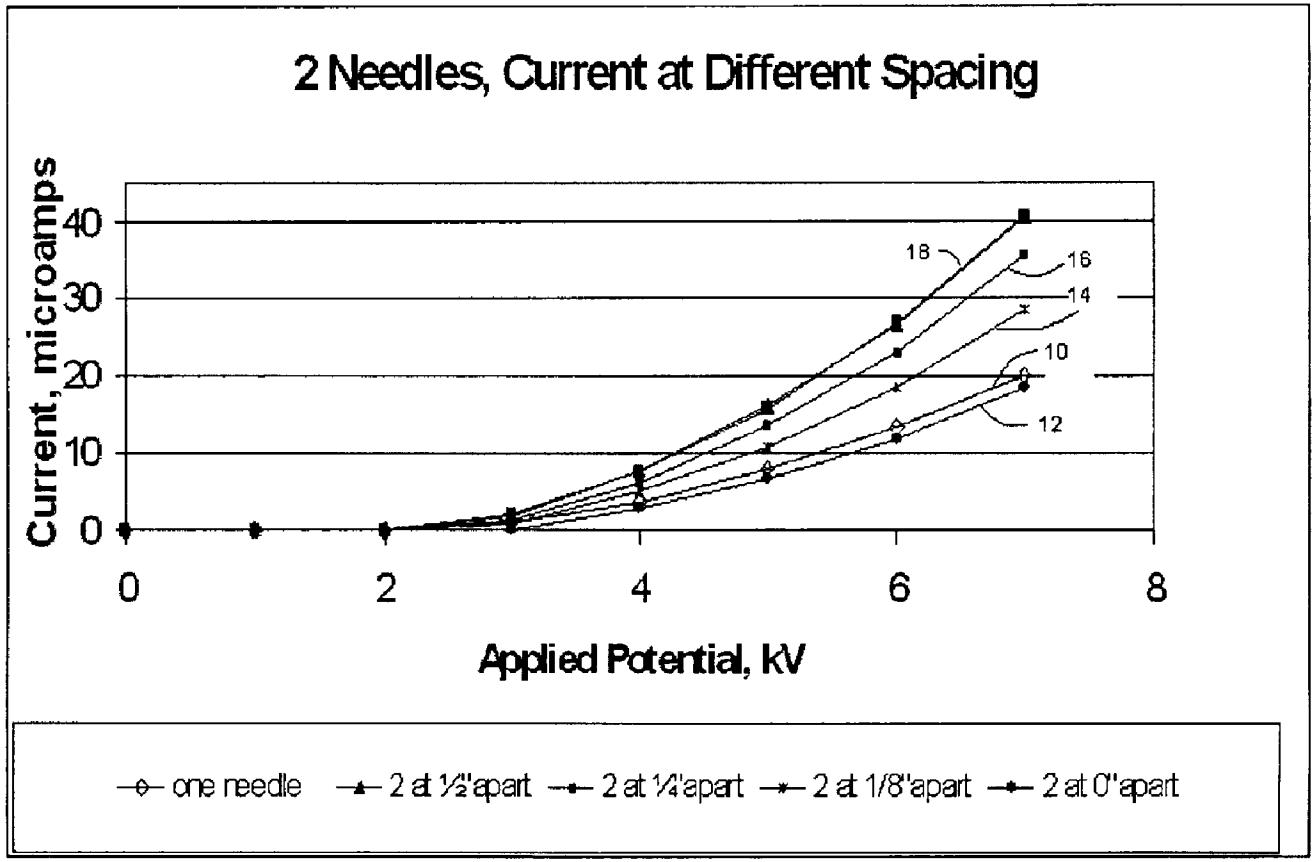
FIG. 2 is a is a graphical plot of the current drawn by a two-needle conductor array as a function of an applied potential.

As can be seen in FIG. 2 two needle projections set 12.5 mm (0.500 inches) apart and each needle spaced 5 mm (0.200 inches) from a statically charged sheet will draw twice as much current as the single needle projection of FIG. 1. The graph of FIG. 2 shows the curve for: 1) a single needle (10); 2) two needles at 0 mm (0 inches) apart (12); 3) two needles at 3.125 mm (0.125 inches) apart (14); 4) two needles at 6.25 mm (0.250 inches) apart (16); and 5) two needles at 12.5 mm (0.500 inches) apart (18). As the needle projections are brought closer together than 6.25 mm (0.250 inches), the current drawn by the needle projections drops off. When the needles are touching, as in 12, there is less current drawn than with the single needle 10. Therefore, based on the data, it is shown that an effective passive apparatus for eliminating static electrical charges from a web of dielectric sheet material can be effectively made by arranging an array of sharp needle projections spaced 12.5 mm (0.500 inches) apart from each other and projecting them to within approximately 5 mm (0.200 inches) of the surface of the sheet material.

Figure 3:
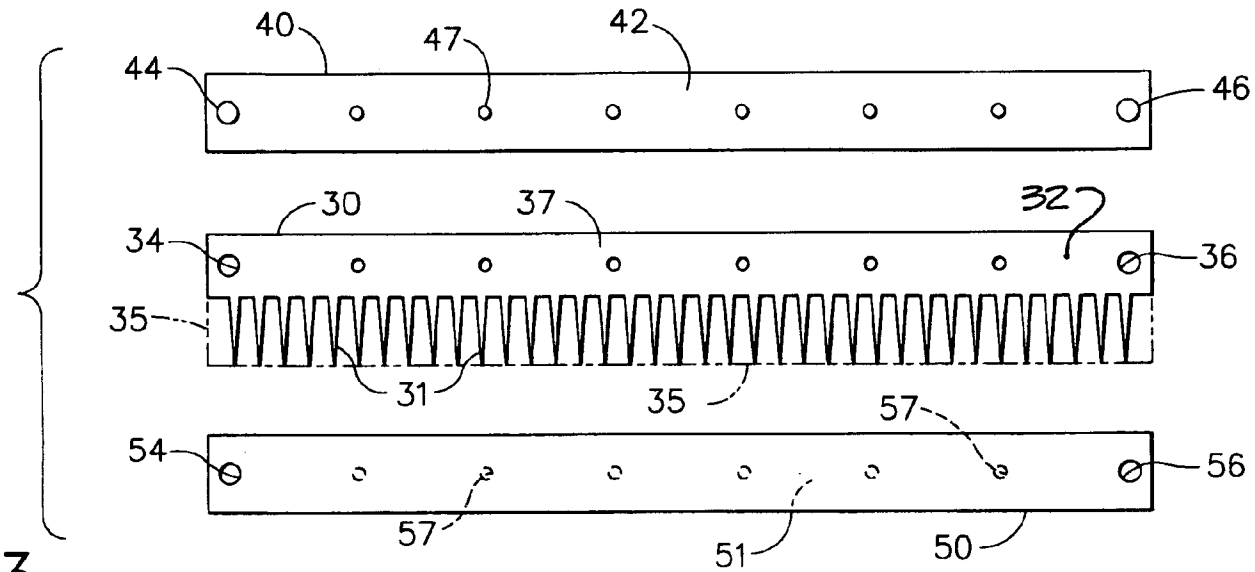
FIG. 3 is an elevational view of the components of the apparatus for eliminating static electrical charges from a web of dielectric sheet material in accordance to the present invention.

Turning now to FIG. 3, the unassembled components of the apparatus of the present invention are shown. The components include a needle array 30, an isolator 40 and a clamp 50.

The needle array as can be seen is composed of a plurality of needle-like extensions 31 extending from a planar ribbon-like upper portion 32. The needle array 30 is fabricated from single piece of 0.05 mm (0.002-in.) thick stainless steel foil ribbon. A lower portion 35 of the foil ribbon is etched away using any of the presently-known techniques for etching metals to form the needle extensions 31. Other means of fabricating the foil can also be used, such as Electrostatic Discharge Machining (EDM). The fabrication of the needle array 30 by etching or the use of EDM provides for a lower-cost alternative then the more conventional needle array fabrication technique of mounting sharp needles on holders.

The upper portion 32 also has a plurality of registration holes 37 etched along upper portion 32, which are used to properly assemble the needle array 30 to the other components of the apparatus. Finally, upper portion 32 includes first and second mounting holes 34 and 36 respectively, each hole located at opposite ends of the needle array 30.

The isolator 40 is composed as a monolithic structure from a good, electrically insulating material such as DELRIN® or the like (DELRIN is a registered trademark of the E. I. Dupont De Nemours and Company Corporation). The isolator 40 is substantially the same physical dimension in plan view as the upper portion 32 of needle array 30. A first surface 42 of isolator 40 includes a plurality of dowel like projections 47 that extend perpendicularly from first surface 42. Each projection 47 is located and arranged to be received and accepted by an associated and respective registration hole 37 of needle array 30. The registration dowels 47 ensure that the needle array 30 is properly mounted and aligned on the isolator 40. Finally, isolator 40 also includes first and second mounting holes 44 and 46, each located on opposite ends of the isolator.

Figure 4:
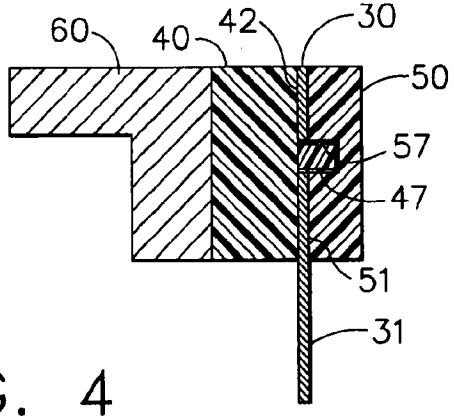
FIG. 4 is a sectional view through the assembled apparatus of the present invention.

The final component of the apparatus of the present invention is a clamp 50. Clamp 50 is also composed as a monolithic structure from a good electrically insulating material such as DELRIN® or the like. The clamp 50 is also substantially the same physical dimension as isolator 40 and the upper portion 32 of needle array 30. A back surface 51 includes a plurality of cavities 57 that are arranged to accept therein an associated and respective one of isolator 40 dowels 47. As can be seen in FIG. 4, each dowel 47 passes through an associated and respective one of registration holes 37 to be accepted within an associated and respective one of cavities 57. The clamp 50 also includes first and second mounting holes 54 and 56 respectively, each located on opposite ends of the clamp.

Figure 5:
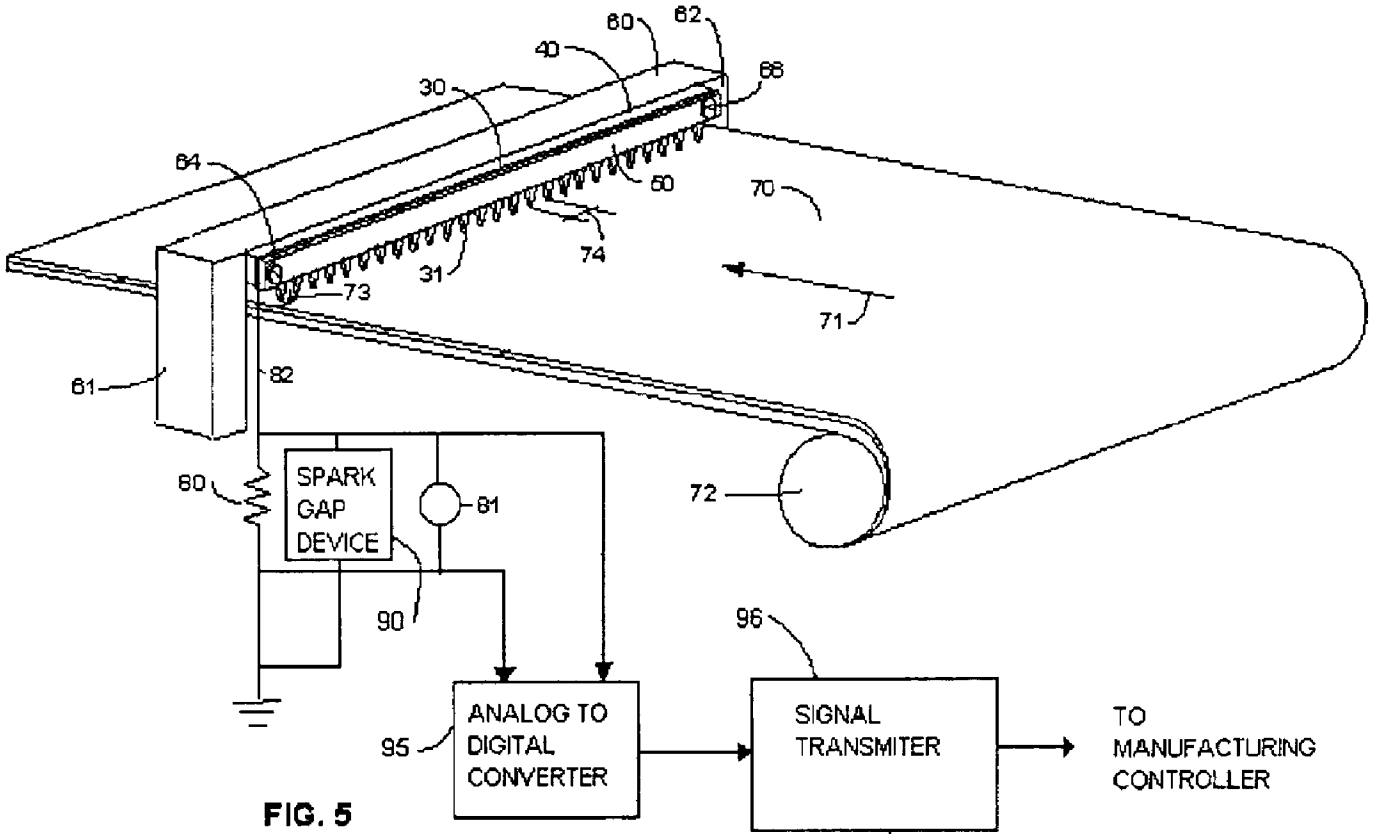
FIG. 5 is a perspective view of the apparatus for eliminating static electrical charges assembled and mounted over a web of sheet material and connected to a grounding circuit in accordance to the present invention.

When the apparatus is assembled, each first hole 44, 34 and 54 and each second hole 46, 36, 56 form first and second fastener receivers, each arranged to receive a single threaded fastener, such as fasteners 64 and 66 shown in FIG. 5. The threaded fasteners engage threaded holes located on a mounting bar 60 (not shown) thereby retaining the assembled apparatus together and also mounting the assembled apparatus to mounting bar 60 shown in FIG. 4 and FIG. 5.

It will be apparent to those skilled in the art that due to the monolithic nature of the needle array 30, its assembly to its associated components 40 and 50 is easier than the handling, positioning and installation of a plurality of individual sharp needles in a holder. Beside apparent advantages in the initial manufacture of the apparatus, the monolithic nature of the needle array 30 allows for the quick and cost-efficient replacement of the needle array 30 in the field when necessary due to damage or wear.

With renewed reference to FIG. 5, the apparatus of the present invention is shown mounted to a device having a web of sheet material traveling thereon. The sheet material 70 when manufactured or handled travels in the direction of arrow 71 from a roller 72. It will appreciated by those skilled in the art, that the sheet may also travel in an opposite direction toward roller 72, and the invention is not limited thereto. The apparatus of the present invention is mounted to a mounting bar 60. Mounting bar 60 is attached by any convenient means to supports 61 and 62, locating the apparatus of the present invention over the sheet 70. The assembly of the present invention consisting of isolator 40, needle array 30 and clamp 50 is assembled together and mounted to mounting bar 60 via fasteners 64 and 66. With the apparatus properly mounted to bar 60, needle extensions 31 extend over the surface of sheet 70 to within 0.250 inches of its surface as shown by 73. As can be seen, a plurality of needle extensions 31 extends transversely along sheet 70 in a cross-direction to the sheets normal direction of travel 71. Each needle projection 31, as explained earlier, is located 0.500 inches from an associated needle extension on either side as shown by 74.

The needle array is connected to ground potential by a suitable conductor 82. Conductor 82 is connected to the needle array 30 by any convenient method or means that affords a good electrical connection, such as by soldering or via a mechanical fastening device. The conductor is appropriately sized to safely handle the electrical currents produced by the apparatus of the present invention.

It is also desirable to provide a method or means of measuring the static electrical charges drained by the apparatus from the sheet 70. This has advantage in indicating how well the static discharge system is working, it can be used to ascertain what conditions of manufacture or environmental conditions produce more or less static electricity and also it can indicate which products are more susceptible to static build-up.

The measurement of the current drained by the apparatus can be accomplished by connecting a resistor 80 to conductor 82 in series between the apparatus and the ground potential. The potential voltage drop across the resistor 80 can then be measured or indicated by ordinary electronics 81, such as a volt-ohm meter or other suitable gauge indicator. The current drained from sheet 70 can then be determined from the voltage measurement. Since the ordinary impedance between the apparatus of the present invention and the sheet of materials 70 is approximately 1000 meg-ohms, a one meg-ohm resistor has little effect on limiting the discharge current potential of the circuit. Therefore, a one meg-ohm resistor can be used for resistor 80 that would provide several volts of potential voltage drop across it.

Sensitive voltage measurement equipment used to measure the voltage potentials drained by the apparatus of the present invention require being protected against catastrophic voltages that may be produced by the volatile discharge of static electrical potentials. Static electrical potentials of the dielectric sheet 70 can be several thousand volts. If a volatile discharge or arcing occurs between the sheet 70 and the needle array 30, the impedance between the sheet 70 and the needle array 30 drops from 1000 meg-ohms to close to zero, thus placing the full several thousand volts of static potential across the input of resister 80. To guard against this type of volatile discharge and the resulting catastrophic voltages, a spark gap device 90 is placed in parallel to resister 80 and before the input of meter 81. The spark gap device 90 may consist of two sharp electrodes placed in close proximity to each other. When the potential across the input exceeds about 1000V, an arc forms across the electrodes and shorts the input to ground potential before damage occurs to the meter 81 or resistor 80. It will be understood by those skilled in the art that other means of draining away catastrophic voltages due to the volatile discharge of static electrical potentials can be used and the present applications is not limited thereto.

As mentioned above, it is desirable to provide a method or means of measuring the voltage potentials drained by the apparatus from the sheet 70 to indicate how well the apparatus of the present invention is working or to ascertain what conditions of manufacture or environmental conditions produce more or less static electrical potentials. However, this measurement can also be used to advantage to control certain parameters of sheet manufacture so as to minimize or mitigate the build-up of static electrical charges.

For instance, on a paper-making machine, the static electrical charges buildup on the sheet is correlated to the moisture content of the sheet. Higher moisture content generally results in lower static electricity on the sheet. If the voltage measured by resistor 80 was high, running the paper-making machine at the highest allowed moisture level for the paper grade would help reduce static electrical potentials on the sheet. Conversely if the voltage measured by resistor 80 was low, the moisture content could be reduced.

In modern paper-making machines, a machine or process controller is used to control certain paper sheet manufacturing parameters such as moisture content, gloss, water weight, etc. Therefore, the voltage produced by resister 80 can be applied to the manufacturing controller as a signal representative of the static electrical charges present on the sheet. The controller can then use this input signal to adjust certain parameters of the sheet manufacturing process in order to minimize the build-up of such static electrical charges. With renewed reference to FIG. 5, the present invention teaches a method of converting the voltage measurement produced by resistor 80 into digital signals for use by a manufacturing controller to adjust certain parameters of sheet manufacture in order to minimize the build-up of static electrical charges.

The voltage dropped by resistor 80 is first applied to an analog-to-digital converter circuit 95. The circuit 95 receives the voltage produced by resistor 80 and produces digital signals representative of the magnitude of voltage produced by resistor 80. The digital signals produced by analog-to-digital converter circuit 95 are next applied to a signal transmitter 96. Signal transmitter 96 is arranged to transmit the digital signals to a manufacturing controller (not shown) associated with the dielectric sheet-making process. Depending on the manufacturing controller and/or the manufacturing process, the digital signals can be transmitted to the manufacturing controller from the signal transmitter 95 on a continual basis, at set intervals, or upon a request by the manufacturing controller to the signal transmitter 95. Upon receiving the digital signals, the manufacturing controller can use the information to adjust certain manufacturing parameters, such as the introduction of moisture to the sheet. It will also be understood by those skilled in the art that the arrangement just described can also be used to implement the storage of digital signal measurements to a historical database for reference and study at later time. It will also be understood that other means and methods of conveying the measured voltage dropped by resistor 80 to the manufacturing controller can be used, and the apparatus of the present invention is not limited to the arrangement shown herein.

Finally, the apparatus of the present invention is shown with a single row of needle extensions 31. It will be apparent to those skilled in the art that the apparatus can be easily modified to add a second or more rows of needle extensions so as to increase the static electricity removal capabilities of the apparatus.

The present invention has been described with particular reference to the preferred embodiments thereof. It will be obvious that various changes and modifications can be made therein without departing from the spirit and scope of the invention as defined in the appended claims.

What is claimed is:

1. An apparatus for draining concentrated static electrical charges built-up on a traveling web of dielectric material comprising:

discharge means comprising at least one monolithic metal foil member, said metal foil member including a plurality of spaced apart needle point projections extending from said metal foil member, each needle point projection located adjacent another needle point projection in a linear array whereby said discharge means is connected to ground potential and each needle projection of said plurality of needle point projections is mounted in close proximity to the surface and in cross-direction to the direction of travel of said web of dielectric material;

an isolator member composed of an insulating material and including isolator member assembly means;

a clamp member comprised of an insulating material and including clamp member assembly means;

said metal foil member further including a planar portion having metal member assembly means arranged thereon, whereby said metal member planar portion is adapted to be captured and retained between said isolator member and said clamp member with said isolator assembly means, metal member assembly means and said clamp member assembly means cooperating to engage and retain said metal member between said isolator and said clamp with said linear array of needle point projections extending from said assembly thereby forming a discharge assembly; and responsive to said concentrated static electrical fields said needle point projections cause ionization of the gasses surrounding said discharge means thereby draining the static electrical charges to said ground potential through said discharge means.

2. The apparatus as claimed in claim 1, wherein each of said discharge means needle point projection is mounted within 5 mm of the surface of said traveling web and each needle point projection is spaced at 12.5 mm from an adjacent needle point projection.

3. The apparatus as claimed in claim 1, wherein said apparatus further includes a mounting bar, said mounting bar located traversly across the surface of said of said web of dielectric material and said mounting bar further includes threaded member receiving means and each of said clamp member, metal member and isolator member further include threaded member thru-holes that when said clamp member, metal member and isolator member are assembled into said discharge assembly said thru-holes are aligned and arranged to receive there-in threaded members that engage said mounting bar threaded member receiving means, thereby retaining said discharge assembly to said mounting bar.

4. An apparatus for draining and measuring concentrated static electrical charges built-up on a traveling web of dielectric material comprising:

discharge means comprising at least one monolithic metal foil member, said metal foil member including a plurality of spaced apart needle point projections extending from said metal foil member whereby said discharge means is connected to ground potential and each needle point projection of said plurality of needle point projections is mounted in close proximity to the surface of said web of dielectric material and in cross-direction to the direction of travel of said web and responsive to said concentrated static electrical charges said needle point projections cause ionization of the gasses surrounding said discharge means thereby draining the static electrical charges to said ground potential through said discharge means;

voltage sensing means connected between said discharge means and said ground potential, said voltage sensing means arranged to develop a voltage whose magnitude is proportional to the magnitude of the static electrical charges drained from the web of dielectric material to said ground potential.

5. The apparatus as claimed in claim 4, wherein said apparatus further includes:

measuring means connected across said voltage sensing means for indicating the magnitude of the voltage sensed by the voltage means.

6. The apparatus as claimed in claim 5, wherein said apparatus further includes:

catastrophic discharge arresting means connected between the input of said measuring means and said ground potential, said catastrophic discharge arresting means arranged to bypass sensed voltages equal to or greater than 1000V directly to said ground potential in response to a volatile discharge of static electricity between said web of dielectric material and said discharge means.

7. The apparatus as claimed in claim 5, wherein said voltage sensing means is a resistor connected in series between said discharge means and said ground potential, said resistor arranged to produce a voltage drop whose magnitude is proportional to the electrical current flowing between said discharge means and said ground potential; and said measuring means is a meter device that is arranged to measure the voltage dropped by said resistor.

8. An apparatus for draining and measuring the concentrated static electrical charges built-up on a traveling web of dielectric material, said apparatus arranged to discharge and report the magnitude of static electricity drained from said web of dielectric material, said apparatus comprising:

a manufacturing controller arranged to control the parameters affecting the manufacture of the web of dielectric materials, discharge means comprising a monolithic metal foil member, said metal foil member including a plurality of spaced apart needle point projection extending from said metal foil member whereby said discharge means is connected to ground potential and each needle point projection of said plurality of needle point projections is mounted in close proximity to the surface and in cross-direction to the direction of travel of said web of dielectric material and responsive to said concentrated static electrical charges said needle point projections cause ionization of the gasses surrounding said discharge means thereby draining the static electrical charges to said ground potential through said discharge means;

voltage sensing means connected between said discharge means and said ground potential, said voltage sensing means arranged to develop a voltage whose magnitude is proportional to the magnitude of the static electrical charge drained from the web of dielectric material to said ground potential;

analog-to-digital circuit means connected to said voltage sensing means, said analog-to-digital circuit means receiving the voltage produced by said voltage sensing means and producing digital signals representative of the magnitude of the voltage sensed;

signal transmission means connected to said analog to voltage circuit means and to said controller, whereby said signal transmission means receives said digital signals from said analog-to-digital circuit means and transmits said digital signals to said controller whereby, said controller uses said digital signal to change the parameters that influence the generation of static electrical charges, to minimize the creation of static electrical charges during the manufacture of said web of dielectric materials.

9. The apparatus as claimed in claim 8, wherein said apparatus further includes:

catastrophic discharge arresting means connected between the input of said analog-to-digital circuit means and said ground potential, said catastrophic discharge arresting means arranged to bypass sensed voltages equal to or greater than 1000V directly to said ground potential in response to a volatile discharge of static electricity between said web of dielectric material and said discharge means.

* * * * *